US005875922A

United States Patent [19]

Chastine et al.

[11] Patent Number: 5,875,922

[45] Date of Patent: Mar. 2, 1999

[54] APPARATUS FOR DISPENSING AN ADHESIVE

[75] Inventors: Christopher R. Chastine, Bethlehem; Wesley C. Fort, Norcross, both of Ga.; William L. Hassler, Amherst, Ohio; Howard E. Ulrich, Dawsonville, Ga.

[73] Assignee: Nordson Corporation, Westlake, Ohio

[21] Appl. No.: 948,728

[22] Filed: Oct. 10, 1997

[51] Int. Cl.[6] ..... B67D 5/62

[52] U.S. Cl. ..... 222/1; 222/504; 251/129.15; 335/219

[58] Field of Search ..... 222/1, 504; 251/129.01, 251/129.15; 335/219, 301

[56] References Cited

U.S. PATENT DOCUMENTS

| | | |
|---|---|---|
| 2,114,961 | 4/1938 | Gille . |
| 2,491,905 | 12/1949 | Ray . |
| 3,212,715 | 10/1965 | Cocks . |
| 3,329,347 | 7/1967 | Montgomery . |
| 3,422,850 | 1/1969 | Caldwell . |
| 3,485,417 | 12/1969 | Cocks . |
| 3,531,080 | 9/1970 | Dillon . |
| 3,704,833 | 12/1972 | Wheat . |
| 3,732,893 | 5/1973 | Ziesche et al. . |
| 3,833,015 | 9/1974 | Kneuer . |
| 3,912,133 | 10/1975 | Hehl . |
| 3,921,670 | 11/1975 | Clippard, Jr. . |
| 4,007,880 | 2/1977 | Hans et al. . |
| 4,218,669 | 8/1980 | Hitchock et al. . |
| 4,295,631 | 10/1981 | Allen . |
| 4,453,652 | 6/1984 | Merkel et al. . |
| 4,474,332 | 10/1984 | Kaska . |
| 4,531,679 | 7/1985 | Pagdin . |
| 4,981,280 | 1/1991 | Brandenberg . |
| 4,981,281 | 1/1991 | Brundage et al. . |
| 5,005,803 | 4/1991 | Fritz et al. . |
| 5,022,629 | 6/1991 | Tibbals, Jr. . |
| 5,054,691 | 10/1991 | Huang et al. . |
| 5,178,332 | 1/1993 | Tsukakoshi et al. . |
| 5,192,936 | 3/1993 | Neff et al. . |
| 5,375,738 | 12/1994 | Walsh et al. . |
| 5,535,919 | 7/1996 | Ganzer et al. . |
| 5,794,825 | 8/1998 | Gordon et al. . |

FOREIGN PATENT DOCUMENTS

| | | |
|---|---|---|
| 9738798 | 4/1997 | WIPO . |

OTHER PUBLICATIONS

Principles of Electrical Engineering Series, *Magnetic Circuits and Transformers,* Dept. of Electrical Engineering, Massachusetts Institute of Technology Publication, © 1943.

Exclusive Electromatic Head, Spraymation (Publication) No date.

Nordson® E–700 Electric Gun, Nordson Corporation, Publication Jun. 1991.

*Primary Examiner*—Philippe Derakshani

*Attorney, Agent, or Firm*—Raymond J. Slattery, III

[57] ABSTRACT

An electromagnetic dispenser for dispensing is provided with a housing for guiding and concentrating the outer axial lines of flux in specific regions and then passing them through the pole and plunger. Concentrating the lines of flux in such regions provide for a more compact dispenser, thereby allowing for smaller centerline-to-centerline spacings.

27 Claims, 4 Drawing Sheets

APPARATUS FOR DISPENSING AN ADHESIVE

DESCRIPTION OF THE INVENTION

This invention is directed to a fluid dispenser, such as for the dispensing fluids, such as adhesives, sealants, water and caulks. More particularly, this invention is also directed to an electromagnetically actuated fluid dispenser for dispensing heated fluid materials such as, for example, hot melt adhesives.

It is common in the dispensing of adhesives to use a pneumatic actuated dispenser, whereby a supply of air is used to move a plunger in reciprocal movement, such that a shutoff needle or ball connected to the plunger or armature is moved from or moved to a seat to permit or stop the dispensing of a pressurized fluid adhesive. Electromagnetic dispensers have been developed wherein the plunger is driven open by an electromagnetic field and closed by a spring biasing means.

Electromagnetic dispensers, otherwise known as (electric guns), are generally larger than standard pneumatic dispenser. This increase in size does not lend electric guns or dispensers to be readily useable in multiple configurations, such as mounting a plurality of dispensers side by side to form a bank of dispensers. In many applications, such as carton sealing, it is desirous to apply a plurality of parallel beads to a substrate on fairly close centers. However, due to the larger size of electromagnetic guns it is difficult to apply closely spaced beads of material to substrates.

It therefore is desirous to produce a compact electromagnetic dispenser, which is capable of operating at fast cycle rates, and is also capable of operating in a bank of dispenser so that closely spaced apart beads of material may be dispensed onto a substrate.

Centerline spacing from one gun module to the next is therefore important. If the gun modules are mounted side by side, it may be very desirous to have the centerline spacing as small as possible in order to produce beads having small centerlines. As such, it is desirable that the width of the gun modules be as small as possible.

SUMMARY OF THE INVENTION

It is an object of the invention, according to one embodiment of the invention, to provide an electromagnetic dispenser which does not require dynamic seals. This may be accomplished, for example, by providing a movable plunger which is located in a fluid chamber or bore in which the movement of the distal end of the plunger from the valve seat, does not extend beyond the fluid chamber or bore in the retracted position. Eliminating the dynamic seal eliminates a wear part which may fail.

It is also an object of the invention according to one embodiment of the invention, to provide an electromagnetic dispenser which has improved performance characteristics.

It is also an object of the invention to provide an electrical gun which is capable of closely mounting a plurality of gun modules in side-by-side relationship to provide improved bead-to-bead spacing.

It is an advantage of this invention that improved centerline-to-centerline spacings between gun modules may be obtained by focusing or directing the lines of magnetic flux more towards the front and the back of the module's outer housing, which allows for a reduction in the width of the module.

Some of these and other objects and advantages may be accomplished according to one embodiment by an apparatus for dispensing an adhesive material comprising: a body defining a fluid chamber, the fluid chamber extending from a first end to an outlet at a second end; a fixed pole disposed at the first end of the fluid chamber and extending away therefrom, wherein a portion of said fixed pole is in fluid contact with the fluid material within the fluid chamber; an inlet for coupling the fluid chamber to a source of adhesive material; a coil for generating an electromagnetic field, disposed about a portion of the pole and a portion of the fluid chamber; a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet; and a rectangular housing having a bore therein and a pair of end caps, one cap disposed in each end of said housing and each cap having a bore therein, said housing disposed about the coil; wherein in response to the electromagnetic field, a magnetic circuit is established comprising the pole, the end caps, the housing and the plunger.

Still further, some of these and other objects and advantages may be accomplished by an apparatus for dispensing an adhesive comprising: a housing defining a bore therein, said bore having a first and a second end; an inlet for coupling the bore to a source of adhesive; a pole, extending form the first end of the bore such that a portion of an external surface of the pole is in fluid communication with the adhesive; a coil for generating an electromagnetic field, disposed about a portion of the pole and the bore; a discharge opening coupled to the second end of the bore; a plunger, having first and second ends, disposed within the bore and mounted for reciprocal movement between a closed position and an open position, wherein in said open position, adhesive is dispensed from the discharge opening and in said closed position, adhesive is prevented from being dispensed from the discharge opening; a pair of magnetic end caps disposed within the housing, one located at either end of the coil; a flux guide member, coupled between the end caps having a non-uniform radial cross-section for guiding lines of flux generated by the electromagnetic field between the end caps; and wherein one end cap distributes the flux between the pole piece and the flux guide member, while the other distributes the flux between the plunger and the flux guide member such that the plunger is moved to the open position.

Still further, some of these and other objects and advantages may be accomplished according to an embodiment of the invention by an apparatus for dispensing adhesive comprising: a valve seat body, said body having a stepped bore therein, one end of said bore coupled to a discharge outlet, and an inlet coupled to the stepped bore and adapted to receive a source of adhesive, said valve seat body being non-magnetic; a non-magnetic sleeve member, having a bore therein, one end of the sleeve member engaging the stepped bore of the valve seat body; a pole, attached to a distal end of the sleeve member from the valve seat body and extending from the sleeve member; a coil assembly, for generating an electromagnetic field, disposed about a portion of both the pole and the sleeve member; first and second end caps, each end cap having a bore therein, the first end cap disposed between the coil and the valve seat body and the second end cap disposed about a portion of the pole, a non-circular housing, defining a bore and attached to and extending between the end caps; a plunger, slidably disposed within the bore of the sleeve and the bore of the valve housing for movement from a closed to an open position, such that upon energization of the coil, the plunger moves to an open portion for allowing the discharge of adhesive and upon the de-energization of the coil, the plunger moves to the closed position, thereby blocking the discharge opening of the valve seat body.

Still further, some of these and other objects and advantages may be accomplished according to an embodiment of the invention by a method of dispensing an adhesive material comprising the steps of: directing a flow of said material through a bore containing a plunger slidably mounted and contained therein; directing the flow of said material about a portion of an electromagnetic pole extending from said bore; generating an electromagnetic field; causing the electromagnetic field to pass axially through the pole and said plunger; and further directing the field in concentrated axial areas, parallel to that passing through said pole and plunger; wherein the electromagnetic field effectuates movement of the plunger from a closed to an open position such that the adhesive material is directed past the plunger and discharged from a discharge orifice.

Still further, some of these and other objects and advantages may be accomplished by a method of dispensing an adhesive material comprising the steps of: mounting a plurality of gun modules to a manifold in side-by-side relationship; directing a flow of said adhesive material through a bore of each gun module containing a plunger slidably mounted therein, and further directing the flow of said polymeric material about a portion of a electromagnetic pole; generating an electromagnetic field in one or more of the gun modules, and causing the electromagnetic field for such gun module or modules, to pass axially through the pole and said plunger of the respective gun module, and further directing the field to concentrate the majority of the field in a first face of the module adjacent to the manifold and a second face diametrically opposed to the first face; wherein the electromagnetic field of each module effectuates movement of the plunger of the module from a closed to an open position such that the adhesive material is directed past the plunger and discharged from a discharge orifice.

DESCRIPTION OF THE DRAWINGS

The following is a brief description of the drawings in which like parts may bear like reference numerals and in which.

DEFINITIONS

The following definitions are applicable to this specification, including the claims, wherein;

"Axial" and "Axially" are used herein to refer to lines or directions that are generally parallel to the axis of reciprocal motion of the plunger of the dispenser.

"Inner" means directions toward the axis of motion of the plunger and "Outer" means away from the axis of motion of the plunger.

"Radial" and "Radially" are used to mean directions radially toward or away from the axis of motion of the plunger.

DETAILED DESCRIPTION OF THE INVENTION

For the purpose of the present discussion, the method and apparatus of this invention is described in connection with the dispensing of an adhesive, including hot melt polymeric materials used in adhesive applications. Hot melt materials are those materials which are normally solid at room or ambient temperature but, when heated, are converted to a liquid state. It should be understood that the methods and apparatus of this invention are believed to be equally applicable for use in connection with the dispensing of other heated fluid materials, such as waxes, as well as those adhesives which are normally a liquid at room or ambient temperature and therefore do not require heating and are sometimes referred to as cold glue.

Figure 1:
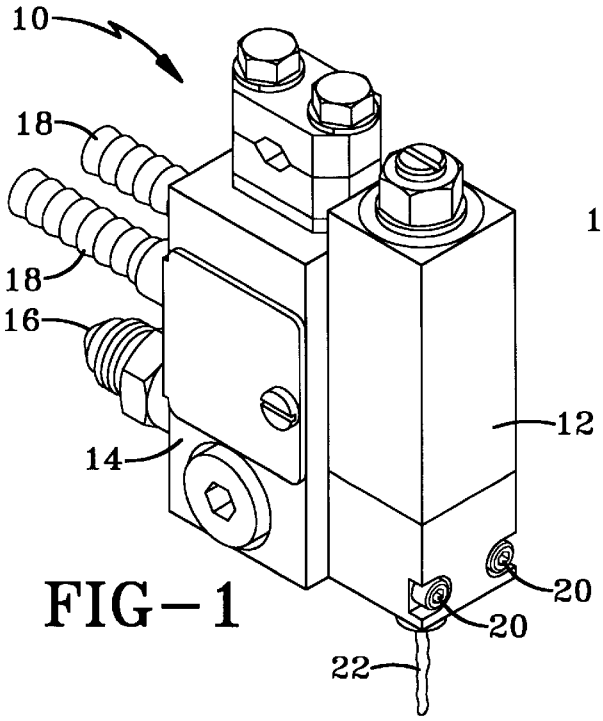
FIG. 1 is a perspective view of a dispenser or gun including a gun module in accordance with one embodiment of this invention.

Now, with reference to FIG. 1, there is illustrated a dispenser or gun, shown generally by reference numeral 10. The dispenser 10 includes a dispenser body, otherwise known as a gun module or valve 12, according to one embodiment of this invention, mounted to a service block 14, otherwise known as a manifold. The service block 14 has an inlet 16, capable of being coupled to an adhesive supply source (not shown) as well as internal fluid passages and an outlet for supplying the adhesive to the module 12 and further contains heaters and temperature sensors, coupled to control circuitry via conduits 18, to maintain the temperature of the hot melt adhesive within the dispenser 10. The dispenser module 12 may be mounted to the service block 14 by mounting screws 20. The module 12 receives the adhesive from the service block and in turn dispenses or applies the adhesive 22 to a substrate.

While the dispenser or gun 10 of FIG. 1 utilizes only one gun module 12, a gun may utilize multiple gun modules. For example, with reference to FIG. 2, there is illustrated a gun, shown generally by reference numeral 10'. The gun 10' includes three gun modules 12A, 12B, and 12C, each identical to gun module 12 of FIG. 1, mounted to a manifold 14' in side-by-side relationship for dispensing 3 streams or beads of adhesive onto a substrate.

Figure 2:
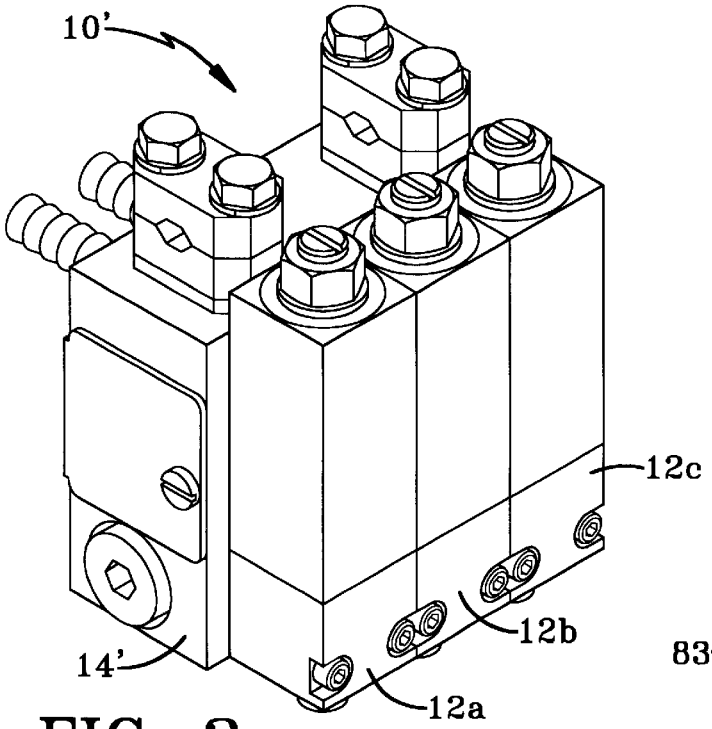
FIG. 2 is a perspective view of a dispenser or gun including three gun modules in accordance with another embodiment of this invention.
Figure 10:
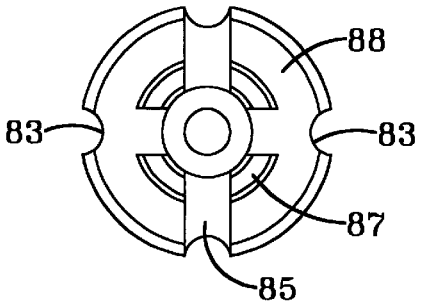
FIG. 10 is an end view of the plunger 50.
Figure 3:
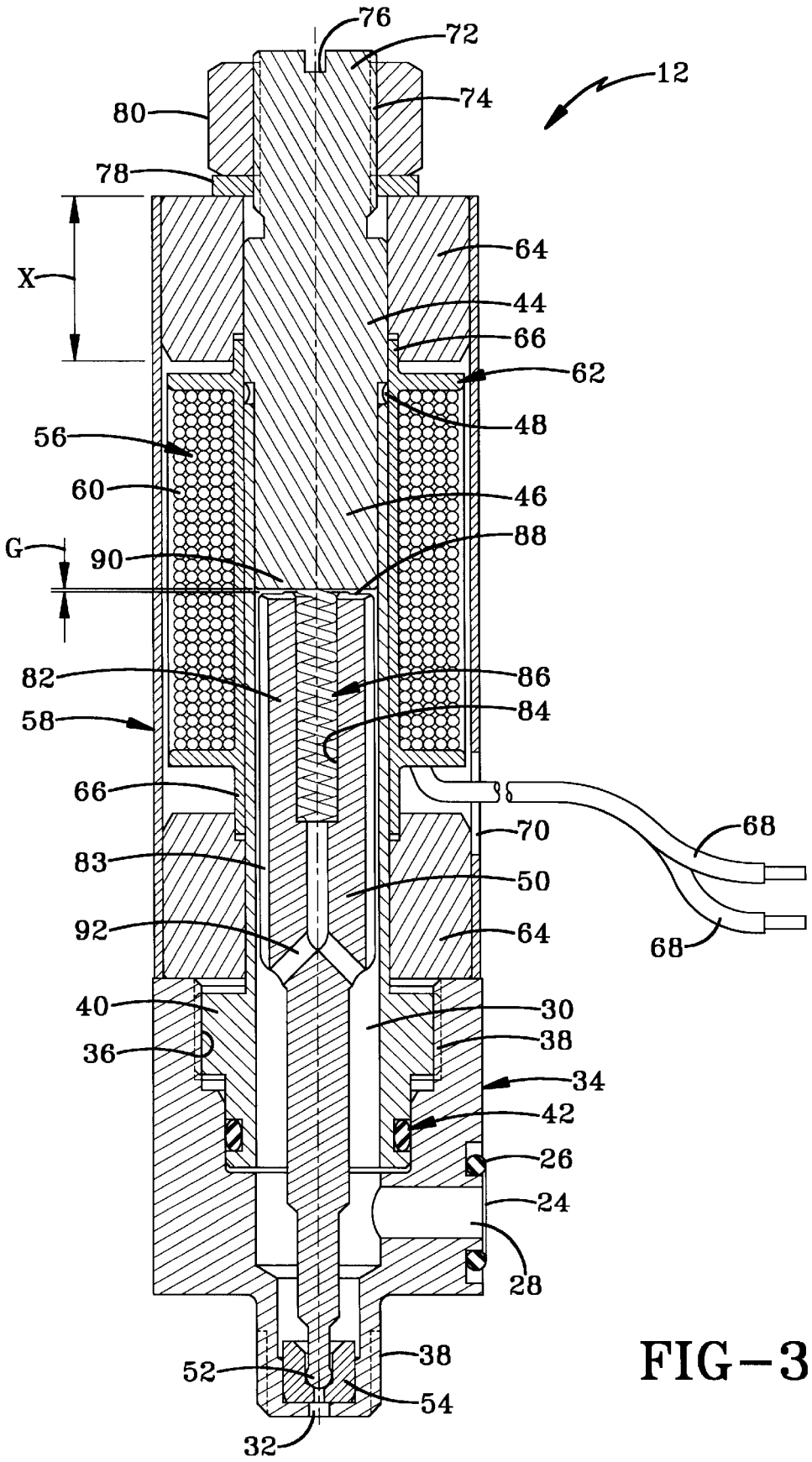
FIG. 3 is an elevational cross-sectional view of the gun modules of FIGS. 1 and 2.
Figure 4:
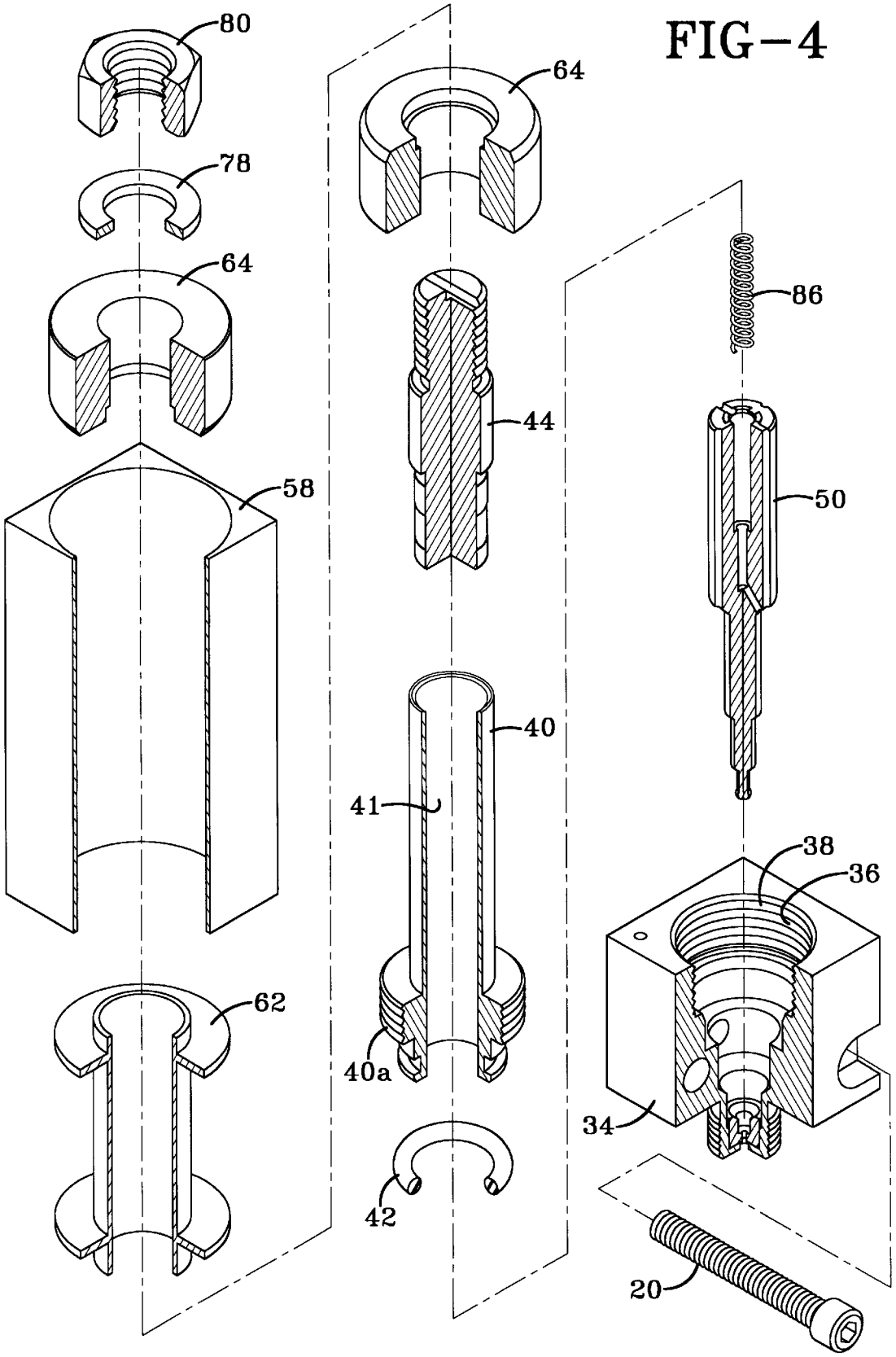
FIG. 4 is a partial exploded view of the gun modules of FIGS. 1 and 2.

Now with reference to additional FIGS. 3, 4, and 10 the gun module 12 of FIGS. 1 and 2 will be more fully described. Gun module 12 includes an inlet port 24 for receiving the liquid material from the manifold or service block 14, 14'. An O-ring 26 is mounted within a groove about the inlet port 24, for sealing and preventing the leakage of material therefrom. The inlet port communicates with a passage 28 to a fluid chamber 30. The fluid chamber 30 is coupled to discharge outlet 32 for dispensing the adhesive material therefrom. Inlet 24, passageway 28, and outlet 32 are all disposed in valve seat body 34. Valve seat body 34 includes a threaded step bore 36. The outer periphery of the valve seat body 34 adjacent to the discharge outlet 32 may include threads 38 for mating with and attaching a nozzle (not shown). Preferably, valve seat body 34 is comprised of brass for those applications employing a heated material, such as hot melt or other thermoplastic materials. This is to provide good heat transfer from the heated manifold 14, 14' in order to maintain the desired temperature of the fluid contained within the gun body 12 prior to dispensing through discharge outlet 32. In the dispensing of other materials, such as cold glue, because of corrosion, the valve seat body may be manufactured from some other non-magnetic material that is more corrosion resistant.

Mounted within valve seat body 34 is a sleeve member 40. Sleeve member 40 includes a bore 41 therein and further including an end 40*a* which threadably engages the threads 38 of stepped bore 36 of the valve seat body 34. End 40*a* further includes a groove for receiving an O-ring 42. Sleeve member 40 should be a non-magnetic material and may be manufactured from a type 303 stainless steel. Sleeve member 40 at its distal end from the valve seat body 34 receives a pole piece 44. Pole piece 44 is manufactured from a ferromagnetic material or other soft magnetic material.

The pole 44 is attached to the sleeve member 40. This may be accomplished by knurling a portion 46 of the pole 44 retained by or within the sleeve member 40 as a pressed fit. The attachment of the pole piece to the sleeve is further accomplished by brazing, such as by forming a brazed ring 48. Unlike the sleeve member, pole piece 44 is of a magnetic material, such as a heat treated magnetic stainless steel, such as 430 FR stainless steel. For certain less corrosive fluids, it is preferred to use a stainless steel having a low chrome content, such as those wherein the chrome content is about 12%.

An electromagnetic coil assembly 56 is located around the sleeve 40 and is enclosed by housing 58. The coil assembly should not be attached to the sleeve member, as the sleeve/pole piece needs to be able to be rotated as will be discussed further. The electromagnetic coil assembly generates an electromagnetic field when it is subjected to a source of electrical power (not shown). The electromagnetic coil assembly 56 includes a coil 60 comprising a plurality of windings wrapped around a bobbin or spool 62. The windings of the coil 60 may be encased in a potting layer of epoxy. The spool 62 is located about the sleeve 40 such that a portion of the pole piece 44 is located within the bore area of the spool.

Located at either end of housing 58 are end caps 64. Each end cap 64 is press fitted flush into the housing 58. The end caps and the housing are comprised of a magnetic material, such as magnetic iron, such as a silicone iron alloy, with a 2½% silicone content or some other ferromagnetic material or soft magnetic material. Preferably the housing is manufactured from the same materials as the end caps. The spool 62 may include an axially extending portion 66 to provide a spacing between the spool from the end caps 64. Preferably, the resulting space between the spool and the end caps is filled with a highly thermally conductive adhesive for bonding the spool assembly with the end caps and the housing 58. Electrical leads 68 pass through an aperture 70 in the housing 58 coupled to a source of electrical power, such as carried by the service manifold 14.

The distal end 72 of pole piece 44 includes the plurality of threads 74 about its periphery, as well as a slot 76. The threads 74 engage a lock washer 78 and a retaining nut 80 for retaining the housing 58 in engagement with the pole 44 and the valve seat body 34.

Pole piece 44, sleeve 40, and valve seat body 34 together form the fluid chamber 30. Located within the fluid chamber 30 is a plunger or armature 50, which is slidably mounted for reciprocal motion. The plunger is also manufactured of a ferromagnetic material or other soft magnetic material. The plunger 50 has a valve needle 52, such as a ball, located at one end of the plunger 50 for mating with a seat 54, located within the valve seat body 34, in the closed position. Seat 54 may be a carbide seat brazed into valve seat body 34. The plunger 50 is stepped having a first portion 82 having a diameter which closely approximates that of the diameter of the bore 41 of the sleeve member. This helps to keep the plunger properly aligned as it slides back and forth. While a close fit provides for good guiding of the plunger, it does not provide a good flow path for the material. Therefore, in order to help the fluid material to flow past the first portion 82 includes bypass channels 83 extending axially along the outer periphery. Causing the fluid to flow past the plunger in this manner helps to prevent dead spots from occurring in the flow of the adhesive through the dispenser, as well as helping to reduce the force required to move the plunger back and forth. With dead spots, the fluid may begin to oxidize to produce undesirable particles or chunks, commonly know as char. Preferably, the bypass channels have a semi-circular cross-section. Having a semi-circular cross-section provides for better magnetic efficiency and improved fluid flow over a straight sided slot.

The first portion 82 of the plunger 50 further includes a stepped bore 84 having a spring 86 retained therein for engaging the plunger 50 and the pole piece 44. The spring 86 provides a biasing force for urging the ball 52 into engagement with the seat 54 to prevent the flow of material from the discharge outlet 32.

When dispensing, the face 88 of the first portion 82 of the plunger 50 will be adjacent to and/or in contact with the end 90 of the fixed pole 44. Fluid material trapped between face 88 of the plunger 50 and the end 90 of the pole 44 will contribute to an increase in the force required to begin to move the plunger to the closed position and/or will cause the closing response time to increase. This phenomenon is similar to the increase in force that is required to separate two pieces of glass which have a drop of fluid placed in between them. As used herein, this phenomenon will be referred to as squeeze film lubrication.

It has been previously known to provide a raised annular ring to the face of the plunger in order to minimize the contact area between the plunger and the fixed pole in order to reduce the effect of squeeze film lubrication. See, for example, U.S. Pat. No. 4,951,917 to Faulkner, U.S. Pat. No. 5,375,738 to Walsh, et al. the related disclosure of each, is incorporated herein by reference. It is preferred in this embodiment to utilize 4 portions 87 or segments of an annular ring as oppose to a complete ring, each segment being equally spaced about the pole face of the plunger. Not only does this reduce the squeeze film lubrication force, but also provides a means for reducing the residual magnetism within the plunger. This is accomplished by reducing the cross-sectional area in contact between the pole face of the pole and the face of the plunger.

Furthermore, in order to further help reduce the effect of squeeze film lubrication, it has been found to be beneficial to provide a means for introducing a flow of fluid between the pole 44 and the plunger 50 to provide vacuum relief. This may be accomplished by providing angled flow channels 92 for intersecting with the stepped bore 84 and which open into the fluid chamber 30.

As the plunger 50 begins to move toward the closed position fluid is directed into the openings of fluid channel 92, into stepped bore 84, and eventually into the area formed between the fixed pole 44 and the face 88 of the plunger 50. The introduction of fluid into this area from bore 84 reduces the vacuum like attraction force between the pole and the plunger as the plunger is being driven to the closed position.

To help further, the face 88 may be provided with a radial channel 85 intersecting with the through bore 84. Preferably radial channel 85 has a semi-circular cross-section.

Furthermore, the flow path 84, 92 helps in decreasing the response time necessary to move the plunger to the open position. As the plunger moves from the closed to the open position, there is fluid between the face 88 of the plunger and the pole piece 44 which must be displaced. The head, acting much like a piston will displace fluid through the bypass channels 83, as well as through flow channels 84 and 92, and into the fluid chamber 30.

In that it is desirous to keep the heat generated by the coil to a minimum, reducing the magnitude of the current passing through the coil will, therefore, help reduce the amount of heat generated by the coil. Once the plunger has moved to its full open position, the magnitude of the current passing through the coil may be reduced to a lower hold in current. In other words, current may be sent to the coil in order to generate an electromagnetic field which quickly drives the plunger from the closed to the open position. However, once in the full open position, the amount of current required to maintain the plunger at that position is less than it takes to drive it from the closed to the open position. There are several different driving methods which can attain this result. For example, U.S. Pat. No. 4,453,652 (Controlled Current Solenoid Driver Circuit), the disclosure of which is incorporated herein by reference, which is assigned to the assignee of this invention, describes a method of reducing the current flow through a coil once the plunger has moved to its fully extended position. Other current driving schemes could also be used which help reduce the power requirements of the coil.

OPERATION OF THE GUN MODULE

Upon energization of the coil 60, the generated magnetic field will induce an electromagnetic field which will cause the plunger or armature 50 to be attracted to pole piece 44. This force will be sufficient to overcome the force of the spring 86 thereby drawing the face 88 of the plunger 44 towards the end 90 of pole 44. This in turn causes the ball 52 to be spaced from the seat 54 thereby causing a fluid flow path from the fluid chamber 30 to the discharge outlet 32. This allows the adhesive to be dispensed from the outlet 32. When the coil is de-energized, the field collapses and the plunger 50 will be moved back to the closed position by the spring 86.

Figure 5:
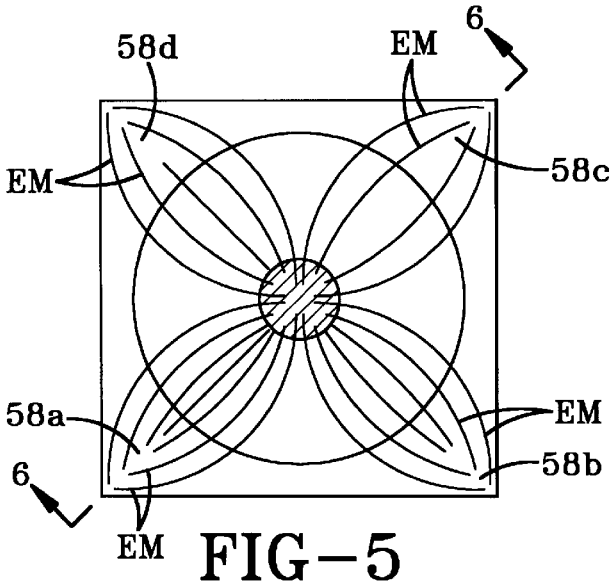
FIG. 5 is a cross-sectional view of the magnetic circuit of FIG. 6 taken substantially along line 5—5.
Figure 6:
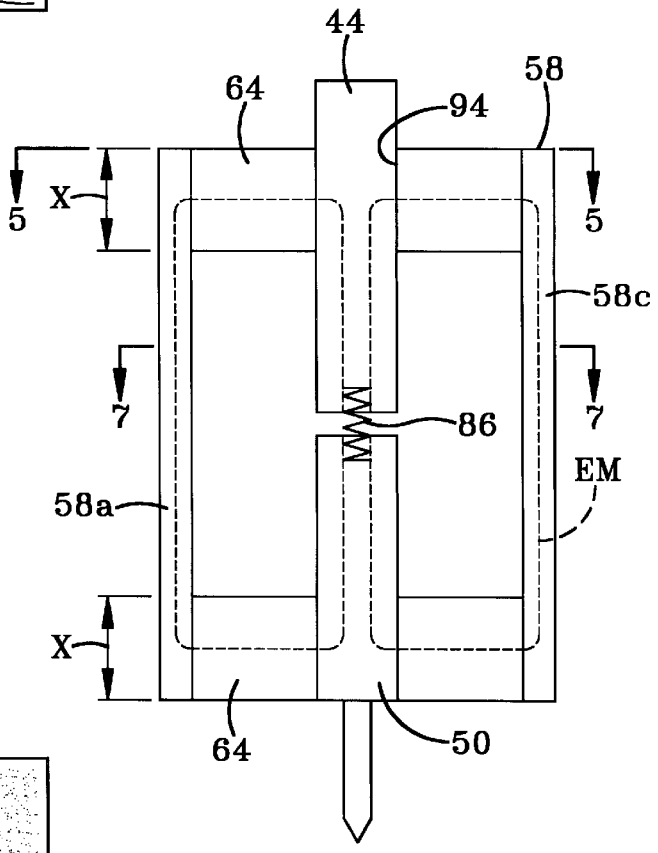
FIG. 6 is an elementary magnetic circuit of the gun module.
Figure 7:
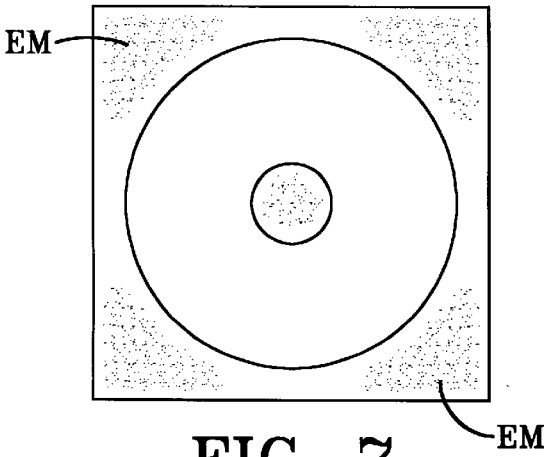
FIG. 7 is a cross-sectional view of the magnetic circuit taken substantially along line 7—7.

The electromagnetic field generated however, is not symmetrical throughout the axial length of the gun module. For example, with reference to FIGS. 5 through 7, the magnetic circuitry of the gun module is represented schematically. When the coil is energized, the electromagnetic field or lines of flux, shown generally by reference EM passes through pole piece 44, plunger 50, the end caps 64, and the corners 58*a, b, c, d* of the housing 58*a*. In the end cap regions, rather than the field radiating symmetrically from pole piece 44 or the armature 50, lines of flux are bent or concentrated into the corner regions of the housing. It is preferable that little or no flux passes through the regions between the corners of the housing 58. Therefore, in cross-section, the lines of flux are not distributed uniformly about the housing 58, but rather, are distributed un-uniformly and concentrated in discrete areas. The housing 58, provides a member for guiding the lines of flux of the electromagnetic field between the end caps. In general, the lines of flux in the corners of the housing or guide member 58 will pass axially from one end of the housing to the other and will be parallel to those passing through the pole and plunger.

In traditional electric guns, the outer core or housing is cylindrical. However, by utilizing the same cross-sectional area but re-configurating it into a rectangle or other geometric shape, such as for example a trapezoid, allows for a smaller centerline spacing between the modules. This allows for a smaller spacing between streams of material to be applied to the substrate.

Figure 8:
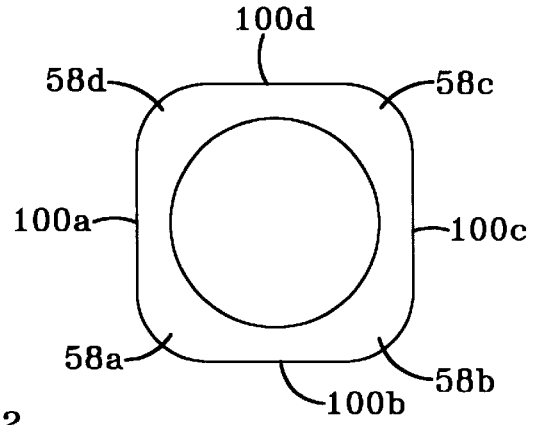
FIG. 8 is a cross-sectional view of an alternate embodiment of a housing or flux guide member.
Figure 9:
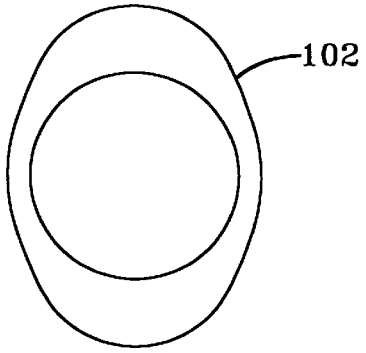
FIG. 9 is a cross-sectional view of an alternate embodiment of a housing or flux guide member.

While the housing is illustrated as having a rectangular cross-section, it is foreseeable to utilize shapes that are substantially rectangular and still obtain the benefit of reduced spacing. For example, with reference to the FIG. 8 corner regions 58*a–d* of the housing could be rounded while still having substantially flat sides 100*a–d,* therebetween. Alternatively, the flat sides could each be somewhat curved. For example, with respect to FIG. 9, the outer periphery 102 of the housing may have a configuration that is substantially that of an ellipse or substantially oblong.

The thickness X of an end cap 64 is a function of the internal surface area of the bore 94 of the end cap. The internal surface area of the bore 94 of an end cap should be equal to the cross-sectional area of the housing 58.

The fitting of the gap G between the pole 46 and the armature 50 is preferably in the 0.010"±0.001. However, the stroke of the plunger 50 can be adjusted by inserting a screw driver into the slot 76 of pole piece 46. Rotating pole piece 46 causes sleeve member 40 to be adjusted by rotating on the threads of the valve seat body 34. In fitting the gap G, it is preferred to tighten the pole/sleeve assembly 44/40 until it has bottomed out in the valve seat body 34. The housing 58, including the coil assembly 56 is then placed over the sleeve. Preferably, the body 58 has a locating pin which matches up with a corresponding hole the valve seat body 34. Once in place, the lock washer and nut are then tightened. Preferably, a nozzle gauge is then attached to the valve seat body by screwing it onto the threads 38. With the sleeve/pole bottomed out, the plunger 58 should not move. Using the screw driver in slot 76 of the pole piece, the pole piece may be rotated until the gauge indicates that the proper gap setting has been obtained. At which point in time the nut 80 may be tightened completely and the gap, i.e. the movement of the ball from the seat as recorded by the gauge provides a spring force against the ball, can be verified.

While certain representative embodiments and details have been shown for the purpose of illustrating the invention, it will be apparent to those skilled in the art that various changes and modifications can be made therein without departing from the scope of the invention.

It is claimed:

1. A method of dispensing a liquid material comprising the steps of:

directing a flow of said material through a bore containing a plunger slidably mounted and contained therein;

directing the flow of said material about a portion of a electromagnetic pole extending from said bore;

generating an electromagnetic field;

causing the electromagnetic field to pass axially through the pole and said plunger; and further directing the field in concentrated axial areas, parallel to that passing through said pole and plunger;

wherein the electromagnetic field effectuates movement of the plunger from a closed to an open position such that the liquid material is directed past the plunger and discharged from a discharge orifice.

2. The method of claim 1 wherein the field is concentrated into corners of a geometrically shaped housing.

3. The method of claim 1 further comprising the steps of:

de-energizing the electromagnetic field; and reducing the attraction forces between the plunger and a face of the pole.

4. An apparatus for dispensing an adhesive material comprising:

a body defining a fluid chamber, the fluid chamber extending from a first end to an outlet at a second end;

a fixed pole disposed at the first end of the fluid chamber and extending away therefrom, wherein a portion of said fixed pole is in fluid contact with the fluid material within the fluid chamber;

an inlet for coupling the fluid chamber to a source of adhesive material;

a coil for generating an electromagnetic field, disposed about a portion of the pole and a portion of the fluid chamber;

a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet; and a substantially rectangular housing having a bore therein and a pair of end caps, one cap disposed in each end of said housing and each cap having a bore therein, said housing disposed about the coil;

wherein in response to the electromagnetic field, a magnetic circuit is established comprising the pole, the end caps, the housing and the plunger.

5. The apparatus of claim 4 further comprising:

a biasing means for biasing the plunger means in the closed position and wherein upon energization of the coil, the biasing of the plunger is overcome and the plunger is moved to the retracted position.

6. The apparatus of claim 5 wherein the plunger includes a means to reduce squeeze film lubrication forces between said plunger and said fixed pole.

7. The apparatus of claim 5 wherein the plunger comprises:

a first portion having a diameter closely approximating the size of the fluid chamber and a reduced portion extending therefrom, the reduced portion including engaging means for mating with a surface in the closed position.

8. The apparatus of claim 7 wherein said plunger includes at least one external bypass flow channel extending axially for providing a fluid path past the head portion of the plunger.

9. The apparatus of claim 7 wherein the first portion of the plunger includes a face adjacent said pole and a groove or channel extending radially along said face.

10. The apparatus of claim 9 wherein the plunger includes an internal fluid passageway extending from the face of said pole.

11. The apparatus of claim 10 wherein the internal fluid passageway is a stepped bore and includes at least intersecting passageway coupled to the fluid chamber.

12. The apparatus of claim 9 wherein said plunger includes an internal fluid passageway having a Y cross-section, wherein the stem of the extends from the face of the plunger.

13. The apparatus of claim 4 wherein at least one outer surface of a corner area of the housing is rounded.

14. An apparatus for dispensing an adhesive comprising:

a housing defining a bore therein, said bore having a first and a second end;

an inlet for coupling the bore to a source of adhesive;

a pole, extending form the first end of the bore such that a portion of an external surface of the pole is in fluid communication with the adhesive;

a coil for generating an electromagnetic field, disposed about a portion of the pole and the bore;

a discharge opening coupled to the second end of the bore;

a plunger, having first and second ends, disposed within the bore and mounted for reciprocal movement between a closed position and an open position, wherein in said open position, adhesive is dispensed from the discharge opening and in said closed position, adhesive is prevented from being dispensed from the discharge opening;

a pair of magnetic end caps disposed within the housing, one located at either end of the coil;

a flux guide member, coupled between the end caps having a non-uniform radial cross-section for guiding lines of flux of the electromagnetic field between the end caps; and wherein one end cap distributes the flux between the pole piece and the flux guide member, while the other distributes the flux between the plunger and the flux guide member such that the plunger is moved to the open position.

15. The apparatus of claim 14 wherein the flux guide member is rectangular, having a through bore therein.

16. The apparatus of claim 15 wherein the pole is adjustable, for adjusting a gap between the pole and the plunger.

17. The apparatus of claim 16 wherein the plunger has a stepped outer diameter, having a first portion of a first diameter and a second portion of a reduced diameter, the first portion containing a through bore therein having substantially a Y-shaped cross-section, the bore extending from an end of the first portion, said first portion further containing a plurality of axially extending channels about the outer periphery of the first portion and the first portion further carrying a radial channel on a face opposite the pole and said radial channel intersecting with the through bore of the plunger.

18. The apparatus of claim 17 wherein the axially extending channels and the radial channels, each have a semi-circular cross-section.

19. The apparatus of claim 14 wherein the pole is solid, thereby preventing the flow of adhesive therethrough.

20. The apparatus of claim 19 wherein the flux guide member is rectangular, having a through bore therein.

21. The apparatus of claim 14 wherein the end caps are circular, having a through bore therethrough.

22. The apparatus of claim 19 wherein the flux guide member has a non-circular cross-section.

23. The apparatus of claim 14 wherein the flux guide member has one of the following cross-sections; rectangular, elliptical, oblong, or trapezoidal.

24. An apparatus for dispensing adhesive comprising a valve seat body, said body having a stepped bore therein, one end of said bore coupled to a discharge outlet, and an inlet coupled to the stepped bore and adapted to receive a source of adhesive, said valve seat body being non-magnetic;

a non-magnetic sleeve member, having a bore therein, one end of the sleeve member engaging the stepped bore of the valve seat body;

a pole, attached to a distal end of the sleeve member from the valve seat body and extending from the sleeve member;

a coil assembly, for generating an electromagnetic field, disposed about a portion of both the pole and the sleeve member;

first and second end caps, each end cap having a bore therein, the first end cap disposed between the coil and the valve seat body and the second end cap disposed about a portion of the pole, a non-circular housing, defining a bore and attached to and extending between the end caps;

a plunger, slidably disposed within the bore of the sleeve and the bore of the valve housing for movement from a closed to an open position, such that upon energization of the coil, the plunger moves to an open portion for allowing the discharge of adhesive and upon the de-energization of the coil, the plunger moves to the closed position, thereby blocking the discharge opening of the valve seat body.

25. The apparatus of claim 24 wherein the plunger has a stepped outer diameter having a first portion of a first diameter and a second portion of a reduced diameter, the first portion containing a through bore therein having substantially a Y-shaped cross-section, the bore extending from an end of the first portion, said first portion further containing a plurality of axially extending channels about the outer periphery of the first portion and the first portion further carrying a radial channel on a face opposite the pole and said radial channel intersecting with the through bore of the plunger.

26. The apparatus of claim 24 wherein the sleeve threadably engages the valve seat and wherein the pole extends from the housing and is adapted for rotational adjustment.

27. The method of dispensing an adhesive material comprising the steps of:

mounting a plurality of gun modules to a manifold in side-by-side relationship;

directing a flow of said adhesive material through a bore of each gun module containing a plunger slidably mounted therein, and further directing the flow of said polymeric material about a portion of a electromagnetic pole;

generating an electromagnetic field in one or more of the gun modules, and causing the electromagnetic field for such gun module or modules, to pass axially through the pole and said plunger of the respective gun module, and further directing the field to concentrate the majority of the field in a first face of the module adjacent to the manifold and a second face diametrically opposed to the first face;

wherein the electromagnetic field of each module effectuates movement of the plunger of the module from a closed to an open position such that the adhesive material is directed past the plunger and discharged from a discharge orifice.

* * * * *